US007827808B2

(12) United States Patent
Janda

(10) Patent No.: US 7,827,808 B2
(45) Date of Patent: Nov. 9, 2010

(54) METHOD FOR WASHING COOLING OR AIR CONDITIONING CIRCUITS AND DEVICE FOR CARRYING OUT SAID METHOD

(75) Inventor: František Janda, Praha (CZ)

(73) Assignee: Ekotez, Spol. S.R.O. (CZ)

( * ) Notice: Subject to any disclaimer, the term of this patent is extended or adjusted under 35 U.S.C. 154(b) by 989 days.

(21) Appl. No.: 11/597,998

(22) PCT Filed: Jun. 2, 2005

(86) PCT No.: PCT/CZ2005/000046

§ 371 (c)(1),
(2), (4) Date: Nov. 30, 2006

(87) PCT Pub. No.: WO2005/119140

PCT Pub. Date: Dec. 15, 2005

(65) Prior Publication Data

US 2008/0022715 A1 Jan. 31, 2008

(30) Foreign Application Priority Data

Jun. 2, 2004 (CZ) ..... 2004-678

(51) Int. Cl.
*F25B 47/00* (2006.01)

(52) U.S. Cl. ..... 62/85; 62/149; 62/475

(58) Field of Classification Search ..... 62/85, 62/149, 77, 292, 470, 471, 472, 473, 475, 62/126, 195, 125, 129; 210/195.1, 258; 202/95, 202/253, 260

See application file for complete search history.

(56) References Cited

U.S. PATENT DOCUMENTS 5,168,720 A * 12/1992 Keltner ..... 62/292

(Continued)

OTHER PUBLICATIONS

Patent Abstracts of Japan, vol. 2000, No. 21, Aug. 3, 2001 and JP Publication No. 2001 116408, Publication Date Apr. 27, 2001; (Kurokawa Taiji) (Abstract Only).

(Continued)

*Primary Examiner*—Mohammad M Ali
(74) *Attorney, Agent, or Firm*—Barnes & Thornburg LLP

(57) ABSTRACT

The invention relates to a method for washing cooling or air conditioning circuits, according to which a washing agent is conducted through said cooling or air conditioning circuit. Said agent dissolves and absorbs the soluble substances that adhere to the cooling or air conditioning circuits and discharges the mechanical contaminants. The washing agent is conducted through the cooling or air conditioning circuit that is washed in a closed cycle without escaping into the environment, by the pressure differential between the pressure chamber and the distillation chamber and is returned to the pressure chamber after being cleaned in the distillation chamber, compressed by a compressor and cooled in a condenser. The invention also relates to a device for washing cooling or air conditioning circuits, said device consisting of a pressure chamber containing a washing agent. The outlet pipe for fluid of the pressure chamber is connected to the cooling or air conditioning circuit that is washed. A compressor and a condenser, which is connected to a supply line for fluid to the pressure chamber, are connected upstream of said chamber. A distillation chamber is connected between the cooling or air conditioning circuit that is washed and the compressor and inert gas that is compressed by the washing agent is contained in the pressure chamber.

8 Claims, 1 Drawing Sheet

U.S. PATENT DOCUMENTS

Figure 1:
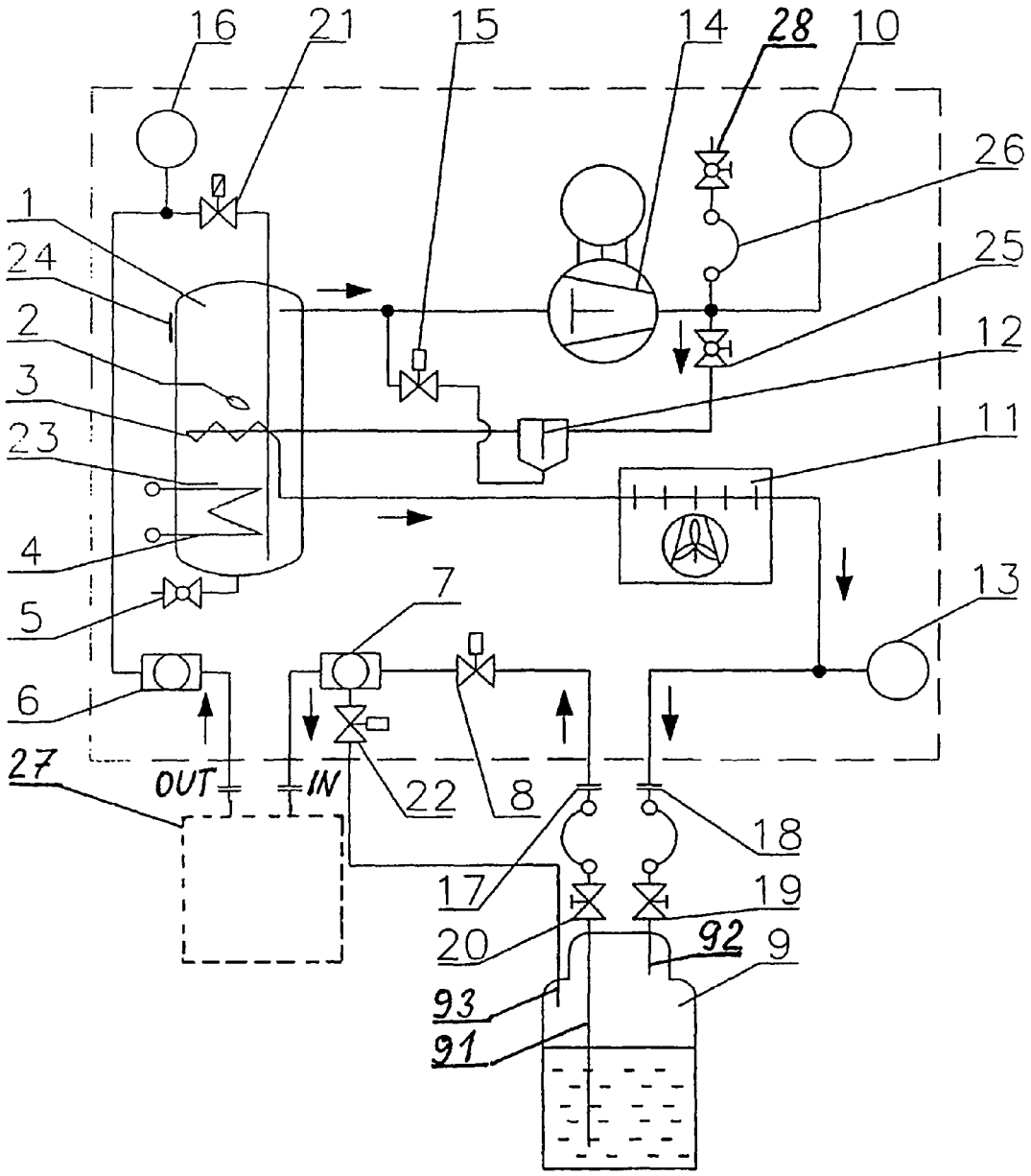

| | | | | |
|---|---|---|---|---|
| 5,174,906 | A | 12/1992 | Henry | |
| 5,181,388 | A * | 1/1993 | Abraham | 62/77 |
| 5,709,091 | A * | 1/1998 | Todack | 62/85 |
| 6,357,240 | B1 * | 3/2002 | Zugibe et al. | 62/85 |
| 6,877,337 | B2 * | 4/2005 | Francois et al. | 62/475 |
| 2004/0231702 | A1 * | 11/2004 | Thomas et al. | 134/10 |

OTHER PUBLICATIONS

Patent Abstracts of Japan, vol. 2003, No. 12, Dec. 5, 2003 and JP Publication No. 2003 302128, Publication Date Oct. 24, 2003; (Shinryo Corp.) (Abstract Only).

* cited by examiner

METHOD FOR WASHING COOLING OR AIR CONDITIONING CIRCUITS AND DEVICE FOR CARRYING OUT SAID METHOD

CROSS-REFERENCE TO RELATED APPLICATIONS

This application is a U.S. national counterpart application of international application serial no. PCT/CZ2005/000046 filed Jun. 2, 2005, which claims priority to Czech Republic application serial no. PV 2004-678 filed Jun. 2, 2004.

The invention relates to a method for flushing cooling or air-conditioning circuits, during which the cooling or the air-conditioning circuits are flushed with a washing agent that dissolves and absorbs any in the circuits remaining soluble compounds and flushes out any mechanical impurities. The invention also relates to the device for carrying out this method and consisting of a pressurized vessel containing the washing agent that is connected, through its liquid outflow, with the flushed cooling or air-conditioning circuit, behind which there is a distilling chamber, a compressor, and a condenser connected with the liquid inflow of the pressurized vessel.

PRIOR ART

The flushing of the cooling or air-conditioning circuits is done after pumping out the refrigerant for the purpose of removing any undesirable impurities, mainly during maintenance or repairs.

The up to now known devices for the flushing of cooling or air-conditioning circuits function in such way, that a washing agent is flushed through the cooling or air-conditioning circuit and it dissolves and absorbs the caught up soluble compounds and carries out mechanical impurities caught up in the cooling or air-conditioning circuit. The washing agent, which should be harmless for the environment, must have high solution ability and there must also exist a method for its easy regeneration—the method for separating dissolved compounds, especially oils and mechanical impurities.

The prior art devices for the flushing of cooling or air-conditioning circuits work in the following way:

a) The washing agent repeatedly runs through the flushed cooling or air-conditioning circuit with the aid of a liquid pump.

b) The washing agent is enclosed in a vessel under pressure, usually of nitrogen. A one-time run of the flushed cooling or air-conditioning circuits is used for the flushing and the liquid is then drained into a collection vessel.

c) A compressor sucks vapor of the washing agent. The state of matter usually takes place in a heat exchanger using the condensation heat from the compressor.

The disadvantage of all prior arts devices relates especially to the long time necessary for the process of flushing cooling or air-conditioning circuits, the weight of these devices, the flushing with the already contaminated washing agent during the step a), the impossibility to repeat the cycle during the step b), and the impossibility to completely and fast remove remaining washing agent from the cooling or air-conditioning circuit. Possible leaks of the media into the environment result just in another disadvantage.

The invention's task thus is to find the method and the device for the flushing of cooling or air-conditioning circuits, which would achieve the perfect flushing of the circuits in a short time. Another invention's task is achieving of the lower weight of the device and the safe disposal of the washing agent flushed out from the cooling or air-conditioning circuits. In addition, the invention's task is also to satisfy the function at low ambient temperatures.

SUMMARY OF THE INVENTION

The above-mentioned tasks and shortcomings of the known processes of this kind are, up to a certain level, resolved by the method of flushing cooling or air-conditioning circuits, during which a washing agent, dissolving and absorbing the in the cooling or air-conditioning circuits caught up compounds and flushing out mechanical impurities, runs through the flushed cooling or air-conditioning circuits, that has been based on this invention. The invention suggests flushing of cooling or air-conditioning circuits with a washing agent circulating within an enclosed cycle, without the occurrence of any outside leaks, thanks to the different pressures between the pressurized vessel and the distilling chamber and, after the cleaning in the distilling chamber, thanks to the pressurizing by the compressor and cooling down in the condenser. Then, the process returns the agent back into the pressurized vessel.

It is considered an advantage that the washing agent runs through the flushed cooling or air-conditioning circuit in the pulse way as it increases the washing intensity and makes the releasing of impurities easier.

It is also advantageous, from the energy savings' point of view, when the washing agent goes through a heat exchanger inside the distilling chamber between the compressor and the condenser.

To ensure the maximal speed of the removal of the washing agent from the flushed cooling or air-conditioning circuit, it is advantageous when the washing agent is pushed out of the flushed cooling or air-conditioning circuit in the liquid state directly into the distilling chamber by the pressure difference between the gaseous stage in the pressure vessel and the distilling chamber.

The invention relates also to the device for flushing cooling or air-conditioning circuits for performing said method. The device consists of the pressure vessel containing the washing agent connected through its liquid outflow with the flushed cooling or air-conditioning circuit, behind which there is the compressor and the condenser connected, which condenser is connected with the liquid inflow to the pressure vessel. The subject matter of the consist in that the distilling chamber is interposed between the flushed cooling or air-conditioning circuit and the compressor and there is pressurised inert gas in the pressure vessel above the washing agent.

For the control of the facility and the achievement of the pulse flow of the washing agent, it is also beneficial when there is the first solenoid valve interposed between the flushed cooling device and the pressure vessel, while the second solenoid valve can be interposed between the flushed cooling device and the distilling chamber.

The placement of a level gauge inside the distilling chamber, which measures the washing agent's level, is also advantageous. It allows for the control of solenoid valves.

Further, the fact that there is a heat exchanger inside the distilling chamber, in between the compressor outflow and the condenser, is advantageous because of the lower consumption of energy.

The method and the device according to the invention are based on the fast flow of the washing agent through the cooling or air-conditioning circuits preferably with the aid of different pressures between the pressurized vessel and the distilling chamber. It results in a negligible dependence on the compressor output as the required performance is achieved even with the use of a low performance compressor and at low ambient temperature.

The overpressure in the pressurized vessel is also used for the fast push out of the liquid pure washing agent from the flushed cooling or air-conditioning circuit into the distilling chamber.

DRAWINGS

The invention is also clarified with the example of its embodiments illustrated on the enclosed drawing, which shows the block device scheme of the flushing of cooling or air-conditioning circuits.

EXAMPLES OF THE INVENTION EMBODIMENTS

The device for the flushing of cooling or air-conditioning circuits 27, according to the invention, consists of a pressurized vessel 9, which contains a washing agent—for example, Genesolv® by Honeywell. The volume of the liquid washing agent in the pressurized vessel 9, kept under pressure by the filled up gas area in the pressurized vessel 9, above the washing agent level, with, for example, nitrogen under 5 bars, is reliably higher (e.g. by 30%) than the assumed volume of the flushed cooling or air-conditioning circuit 27. The pressurized vessel 9 is equipped with at least one outflow 91 for the liquid, which goes down to the bottom of the pressurized vessel 9, and at least one (preferably a couple) outflow 92 (and 93) for gas ending in the gas area in the pressurized vessel 9, above the washing agent level. There is the valve 20 connected with the outflow 91 for the liquid, behind which the first connection 17 is placed. Then, there is the first solenoid valve 8, through which the washing agent runs to the first sight-glass 7 and to the flushed cooling or air-conditioning circuit 27, which has been only schematically illustrated. After running through the cooling or air-conditioning circuit 27, the contaminated washing agent runs behind the second sight-glass 6 to the second solenoid valve 21, in front of which its pressure is measured by the first manometer 16. The washing agent runs through this second solenoid valve 21 to the bottom of the distilling chamber 1, which is equipped with a heater 4, for example an electric one. The washing agent having typically the boiling point, at the atmospheric pressure, of about 15° C. heats up and evaporates. It is sucked from the upper part of the distilling chamber 1 into the compressor 14, from which it runs through the back check-valve 25 and the oil separator 12 to the heat exchanger 3. It helps there in heating up the distilling chamber 1. Then, it runs to the condenser 11 with the marked fan, behind which there is the second manometer 13 connected. The liquid washing agent runs from the condenser through the second connection 18 and the second valve 19 back into the pressurized vessel 9. The oil outflow of the separator 12 could go through the fourth solenoid valve 15 back to the sucking side of the compressor 14.

There is a high pressure pressostat 10 connected behind the compressor 14 as well as the first emptying valve 28 connected with the hose 26. The distilling chamber 1 is equipped in its bottom with the second valve 5 emptying impurities and oil. Inside the distilling chamber 1, there is, above the heat exchanger 3, the level gauge 2—for example, a float—and the safety thermostat 24 fitted on the wall. Inside the distilling chamber 1, on the heater 4, there is the heater thermostat 23 fitted.

The performance of the device for the flushing of cooling or air-conditioning circuits, according to the invention, conforming to the described example is as follows:

The liquid washing agent is stored in the vessel 9 pressurized with nitrogen up to the pressure in order of 5 bars, up to the maximum capacity of 2 thirds of its volume. The volume of the washing agent in the pressurized vessel 9 is by at least 30% higher than the assumed volume of the flushed cooling or air-conditioning circuit 27, including the connection hoses and the distilling chamber 1.

After the connection of the flushed cooling or air-conditioning circuit 27 with the circuit with the inflow IN and the outflow OUT, the compressor 14 must, at first, pump out air from the flushed cooling or air-conditioning circuit 27 and from the distilling chamber 1. This air is emptied through the hose 26 and the first emptying valve 28. The back check-valve 25 is closed during this process. The air is sucked out to the approximate pressure of 0.5 bars.

The first solenoid valve 8 and the second solenoid valve 21 open up and the washing agent flows through the flushed cooling or air-conditioning circuit 27 to the distilling chamber 1 at the speed created by the difference between the pressures in the pressurized vessel 9 and the distilling chamber 1. The compressor 14 runs at the same time and the heater 4 is heating. As soon as the distilling chamber 1 fills up, the level gauge 2—for example, a float—closes the solenoid valves 8 and 21. The washing agent in the distilling chamber 1 heats up to the boiling point and the vapors are sucked out by the compressor 14 and led through the heat exchanger 3 to the condenser 11, and then, condensed, back to the pressurized vessel 9. Only a single cycle is usually necessary for the flushing of the cooling or air-conditioning circuit 27, but the process can be repeated.

The process is finished by the opening up of the third solenoid valve 22, when the first solenoid valve 8 is closed and the second solenoid valve 21 is opened. Pressurized nitrogen in the pressurized vessel 9 pushes the liquid washing agent into the distilling chamber 1, where the agent could be effectively heated up and distilled.

Because of the boiling point of the washing agent, which is typically 15° C. in the case of Genesolv® at the atmospheric pressure, it is practically impossible to evaporate the liquid from the flushed cooling or air-conditioning circuit 27 without the described process, especially at low ambient temperatures.

It is important for the effective performance of the device according to the invention that the clean washing agent always returns back to the pressurized vessel 9 after the distilling in the distilling chamber 1. This results in flushing of the cooling or air-conditioning circuit 27 always with the pure washing agent.

The speed of the washing agent flow in the flushed cooling or air-conditioning circuit 27 depends mostly on the difference between pressures in the pressurized vessel 9 and the distilling chamber 1. It depends only negligibly on the compressor 14 output, which does not have to be high.

The flushing of the cooling or air-conditioning circuit 27 takes place in pulses caused by opening up and closing down of the solenoid valves 8 and 21. These pulses, in connection with the high speed of the washing agent flow, guarantee perfect flushing of the cooling or air-conditioning circuit 27 in a short time.

The pressurized vessel 9 is equipped with at least one separated outflow 91 for the liquid and one, or two outflows 92 and 93 for gas. It is pressurized with nitrogen.

The distilling chamber 1 is heated up by the heater 4—for example an electric one, the heater thermostat 23, and the heat exchanger 3 managing the discharge from the compressor 14. The washing agent level in the distilling chamber 1 is controlled by the level gauge 2, for example, a float. The distilling separates the washing agent from oil, mechanical impurities, and, partly, from water. The reminder of the liquid washing agent from the flushed cooling or air-conditioning circuit 27 is pushed out into the distilling chamber 1 on the end of the process, thanks to impacts of pressurized nitrogen, caused by the opening up and closing down of the third solenoid valve 22. This, at the same time, also removes any remaining mechanical impurities and the liquid washing agent. This design fundamentally speeds up the process, especially at low ambient temperatures.

The invention claimed is:

1. A method of flushing a cooling or air-conditioning circuit, during which a washing agent running through the cooling or air-conditioning circuit dissolves and absorbs in the cooling or air-conditioning circuit caught up compounds and carries out mechanical impurities, the method comprising circulating the washing agent in the cooling or air-conditioning circuit within an enclosed cycle and without any outside leaks, due to a difference in pressures between a pressurized vessel and a distilling chamber and returning back the washing agent to the pressurized vessel after its cleaning in the distilling chamber, pressurized by a compressor, and cooling down in a condenser, wherein during circulating the washing agent, the washing agent exits the distilling chamber and is routed through the compressor and then back through the distilling chamber before the washing agent once again exits the distilling chamber and is routed to the condenser.

2. The method according to claim 1, wherein the washing agent is pulse circulated in a sluiced cooling or air-conditioning circuit.

3. The method according to claim 1, wherein the washing agent runs between the compressor and the condenser through a heat exchanger in the distilling chamber.

4. The method according to claim 1, wherein the washing agent is pushed out from the cooling or air-conditioning circuit in a liquid state directly to the distilling chamber by the difference in pressures in a gas stage in the pressurized vessel and the distilling chamber.

5. A device for the flushing of the cooling or air-conditioning circuit for performing the process, according to claim 1, the device comprising the pressurized vessel containing the washing agent, which is connected through a liquid outflow with the cooling or air-conditioning circuit, behind which there is the compressor and a condenser connected through a liquid inflow with the pressurized vessel, wherein the distilling chamber is fitted between the cooling or air-conditioning circuit and the compressor and wherein pressurized inert gas is in the pressurized vessel above the washing agent.

6. The device according to claim 5, wherein a first solenoid valve is inserted between the cooling or air-conditioning circuit and the pressurized vessel and a second solenoid valve is fitted between the cooling or air-conditioning circuit and the distilling chamber.

7. The device according to claim 6, wherein a washing agent level gauge is placed inside the distilling chamber, which controls the first and second solenoid valves.

8. The device according to claim 7, wherein a heat exchanger is fitted between a compressor outflow and the condenser and the heat exchanger is placed in the distilling chamber, in which above the heat exchanger the washing agent level gauge is positioned.

* * * * *